United States Patent [19]

Heritage

[11] 3,963,294

[45] June 15, 1976

[54] ELECTRICAL CURRENT SUPPLY INSTALLATIONS

[75] Inventor: Robert Heritage, Mortlake, England

[73] Assignee: Rotaflex (Great Britain) Limited, London, England

[22] Filed: Feb. 25, 1975

[21] Appl. No.: 553,017

[30] Foreign Application Priority Data

Feb. 27, 1974 United Kingdom ..... 8986/74

[52] U.S. Cl. ..... 339/22 R; 339/91 R

[51] Int. Cl.[2] ..... H01R 13/60

[58] Field of Search ..... 339/21–24, 339/91 R, 91 F; 240/52, 52.1

[56] References Cited

UNITED STATES PATENTS

| | | | |
|---|---|---|---|
| 2,977,566 | 3/1961 | Neumann et al. | 339/20 |
| 2,987,693 | 6/1961 | Wamsley | 339/186 M |
| 3,044,035 | 7/1962 | Adams, Jr. | 339/21 R |
| 3,112,974 | 12/1963 | Curtis et al. | 339/186 M |
| 3,287,031 | 11/1966 | Simmons et al. | 339/186 R |
| 3,596,226 | 7/1971 | Meltzer | 339/22 B |
| 3,801,951 | 4/1974 | Kemmerer et al. | 339/21 R |
| 3,825,879 | 7/1974 | Hesse | 339/21 R |

*Primary Examiner*—Roy Lake
*Assistant Examiner*—Neil Abrams
*Attorney, Agent, or Firm*—Arthur B. Colvin

[57] ABSTRACT

A power take-off adaptor for use with a continuous outlet current supply track consists essentially of two mechanically and electrically interengageable parts, namely a contact unit and a second unit in the form of a male connector. The male connector may be permanently associated with an appliance and transferred with the appliance between one adaptor contact unit and another, or between such a unit and another receptacle such as a wall or ceiling mounted receptacle.

6 Claims, 6 Drawing Figures

ELECTRICAL CURRENT SUPPLY INSTALLATIONS

This invention relates to electric current supply installations of the continuous outlet type of the well known form comprising a current supply track and individual adaptors which can be inserted at different positions along the track to take current from supply conductors mounted in the track to feed an appliance, such as a light fitting.

The adaptors are usually in the form of self contained units which not only provide the necessary electrical connection between the track conductors and an appliance, but also constitute a mechanical support for fixing the appliance to the track. As a result, each appliance requires its own adaptor. This is not a serious disadvantage in itself, as long as the adaptors are of very simple and cheap construction, for example having fixed contact fingers mounted in a stationary manner in the body of the adaptor.

However, in recent years the design of adaptors has tended to become more complex, due in large measure to the requirement in many cases for the contact fingers to be movable into and out of operative engagement with the track conductors, sometimes involving a facility for moving one or more contact fingers or groups of contact fingers relative to others. As a result, the cost of an adaptor tends to become substantial, and this must be added to the cost of each appliance. Moreover, there are many different forms of track now available, and each requires its own commplementary adaptor, so that, for example, stockists of appliances such as light fittings may have to hold quantities of the same fittings with several different types of adaptor fitted to them.

The present invention aims at reducing these disadvantages and accordingly provides an adaptor for use in electric current supply installations of the continuous outlet type including a track housing supply conductors, the adaptor comprising a housing, contact fingers movably mounted on the housing for engagement and disengagement with respective track conductors, terminal means for connection with an appliance lead, and attachment means for supporting an appliance, wherein the contact fingers are mounted in a contact unit, and the terminal means and attachment means are mounted on a second unit which is releasably interengageable with the contact unit, the two units having co-operating contact means which provide electrical continuity between the contact fingers and the terminal means in the interengaged position of the two units.

By virtue of the above stated features, a number of different appliances may be fitted and supplied with the said second unit in standardised form, for cooperation with different contact units. The second unit is readily designed without moving parts so that it can be of simple and cheap construction, thereby reducing the cost of each appliance. Appliances fitted with the second units can be interchanged at will with one or more of the contact units, instead of each appliance requiring its own, relatively complex, complete adaptor. Furthermore it is possible to design contact units to suit different tracks but all adapted to co-operate with standardised second units.

Preferably, the units have releasable latching means to prevent inadvertent disengagement of the two units and are rendered inaccessible for release when the adaptor is engaged in the supply track.

Conveniently, the units are provided with co-operating guide means in the form of interengageable elongated slots and ribs on the respective units to simplify and ensure correct interengagement of the units.

In accordance with a further constructional feature, the second unit is formed as a male insert and the contact unit is formed with an opening to receive and house the second unit, thus permitting a neat and compact appearance to the complete adaptor.

The said second unit also constitutes a novel form of male connector, having application beyond its use in connection with adaptors but can, for example, be employed for use with other receptacles, thereby providing a convenient form of terminal plug permanently associated with an appliance, such as a light fitting, to facilitate its ready transfer from one receptacle to another, or between a receptacle and a track adaptor, without the usual need to rewire the appliance.

The invention thus includes a male electrical connector adapted for releasable interengagement with a socket fitting, comprising a housing of electrically insulating material, a plurality of contact pins projecting at one end of said housing, attachment means for securing said housing firmly to an appliance or appliance support and elongate location means formed externally on said housing parallel with said contact pins.

One constructional form of the invention will now be described, by way of example, with reference to the accompanying drawings, in which.

Figure 1:
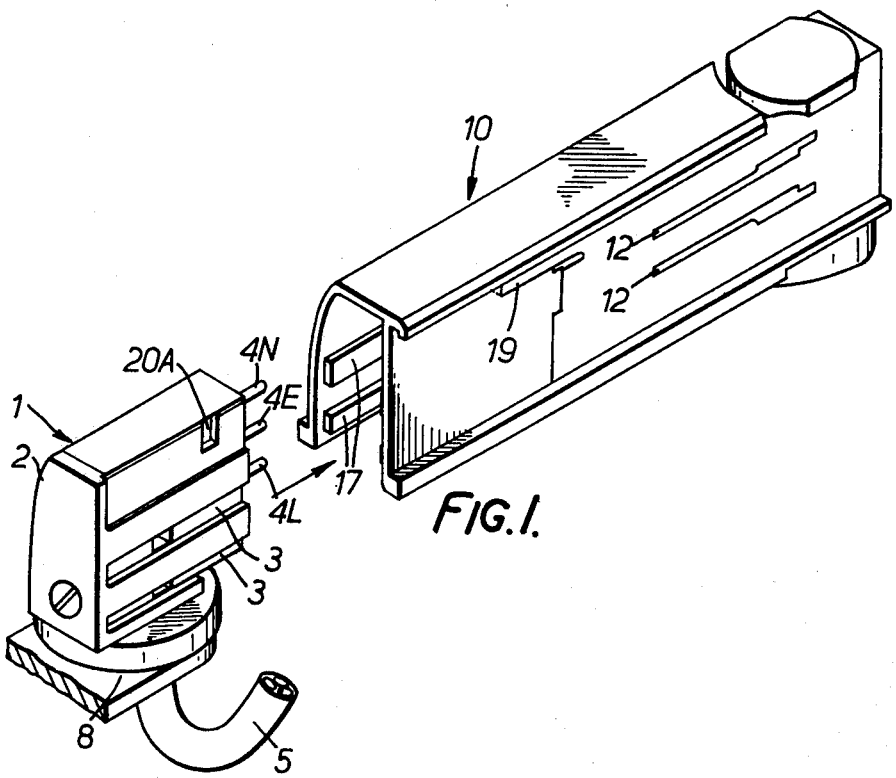
FIG. 1 is an exploded perspective view of an adaptor in accordance with the invention.
Figure 2:
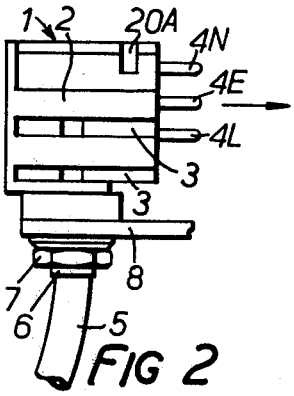
FIG. 2 is a side view of the one unit.

The unit 1 shown particularly in FIGS. 1 and 2 comprises a hollow body or casing 2 of plastics or other insulating material having in each of its side walls two longitudinal guide channels 3. Projecting from one end of the casing 2 are three contact pins 4N, 4E and 4L of conventional form in themselves, provided internally of the casing with terminals for the connection of individual conductors of an appliance lead or flex 5 which is taken out of the bottom wall of the casing through a screwed gland 6, which receives a nut 7 for securing one arm of a support bracket 8 by which an appliance, such as a spotlight fitting, is to be supported. The flex 5 is, of course, connected to the lamp-holder and earth terminal of the fitting. The unit 1 can be dismantled, preferably by virtue of releasable snap-fitting interengagement of the separate parts of the casing 2, to permit connection of the flex to the pin terminals, but it is essentially of rigid construction, without moving parts.

Figure 3:
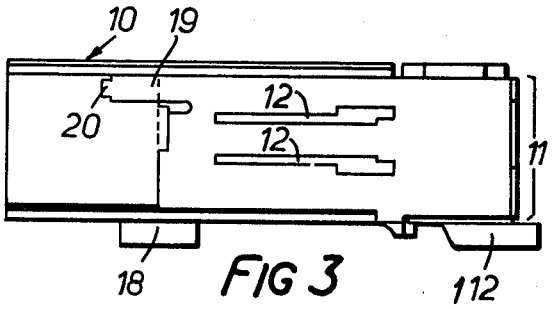
FIG. 3 is a side view of the other unit of the same adaptor.
Figure 4:
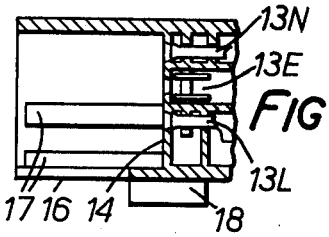
FIG. 4 is a sectional elevation of one end of the unit of FIG. 3.
Figure 5:
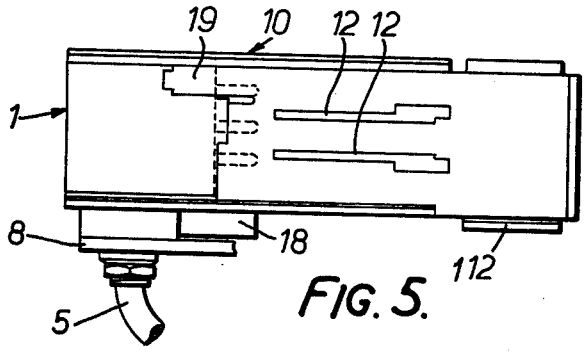
FIG. 5 is a side elevation of the two units assembled to form the complete adaptor.

The contact unit 10, seen in FIGS. 3, 4 and 5, comprises a hollow insulated casing of insulating material, the main part of which comprises a nose portion 11 insertable into a track channel, to be described in more detail below. The right hand portion of the unit 10 houses contact fingers F which are movable between the retracted position within the nose portion, and respective operative positions in which they project laterally outwardly through slots 12 in the side walls of the nose portion. The contacts F are controlled by an operating shaft having a handle 112, and are connected to socket terminals 13N, 13E and 13L accessible through holes in a transverse partition wall 14. To the left of this wall 14, as viewed in FIGS. 3 and 4, the bottom wall of the casing is cut away, at 16, and the opposing side walls are provided with respective pairs of longitudinal guide ribs 17. A stop 18 is provided to prevent excess rotation of a support bracket 8, as will be described below.

Finally, the contact unit 10 has a longitudinal finger 19 integrally joined at its root to the adjacent side wall of the nose portion, and having at its free end an inwardly directed hook 20 for locking the two units together.

To assemble the adaptor, the unit 1 is simply inserted into the open (left hand) end of the unit 10, the guide ribs 17 extending into the channels 3 of the casing 2, to ensure axial alignment of the pins 4N, 4E, 4L with the socket terminals 13N, 13E, 13L. In the initial stage of assembly, the free end of the finger 19 is flexed outwardly, and as the final assembly position is reached, the hook 20 snaps into a locking recess 20A in the adjacent side wall of casing 2 to lock the parts against inadvertent axial separation. In the assembled adaptor, seen in FIG. 5, the unit 1 is contained wholly within the length of the unit 10. In this position, the stop 18 limits rotation of the bracket 8 about the axis of gland 6 to slightly less than 360°, to prevent undue twisting of the flex 5.

Figure 6:
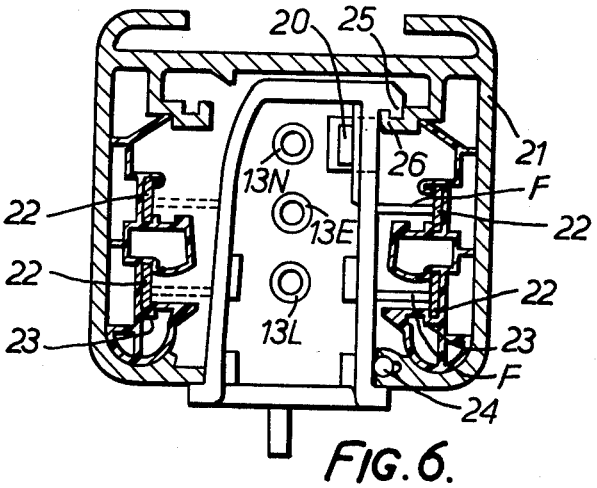
FIG. 6 is a cross-sectional view, on a larger scale, of the unit of FIGS. 3 and 4, installed in a current supply track.

The assembled adaptor is now ready for insertion in a track channel, as shown in FIG. 6 in which the unit 1 has been omitted in the interests of clarity, and which shows the contact unit 10 inserted in a current supply track channel 21 which has four current supply conductors 22 arranged in pairs on opposite sides of the channel embedded in respective conductor supports 23 of extruded plastics material. An earth continuity conductor 24 is also provided at the mouth of the channel. The adaptor unit 10 is supported in the track channel by interengagement of a hook 25 on the nose portion with an upturned flange 26 on the track, latch means, not shown, being provided for locking the parts against inadvertent disengagement. The operating shaft 112 can then be rotated to move the adaptor contacts F out into engagement with the adjacent supply conductors 22.

It will be noted that the weight of the support bracket 8 and any appliance which it carries is transmitted through the side walls and guide channels of the casing 2, and the guide rails and the side walls of nose portion 11 to the hook 25 and track flange 26, all in one vertical plane, and without any load being imposed on that part of the adaptor housing the movable electrical contacts. Another advantageous feature of the adaptor is that separation of the two units 1 and 10 can only be effected when the assembly is removed from the track channel, the locking hook and finger 19 being otherwise inaccessible.

The invention is not limited in its application to adaptors of the form described and illustrated but will be applicable to adaptors of various other forms.

The unit 1 can also be employed with receptacles other than contact units 10, for example it can be used with wall or ceiling mounted socket receptacles specially designed to receive the unit as a male connector fitting.

I claim:

1. A two part separable adapter for use in electrical current supply installations of the type including an elongated track housing supply conductors, said track including a longitudinally extending, laterally open access slot comprising a housing insertible into said track through said access slot, contact fingers movably mounted on said housing, means on said housing for shifting said contact fingers into engagement with said conductors in the inserted position of said housing in said track, a second unit adapted to be mounted in said housing and including an electrical appliance support supported thereon, terminal means on said second unit electrically connected to said appliance, said terminal means supported thereon, terminal means on said second unit electrically connected to said appliance, said terminal means being positioned to be electrically connected to said contact fingers of said housing responsive to movement of said unit to the mounted position thereof in said housing, complemental locking means on said housing and said second unit manually shiftable between engaging and disengaging positions, respectively locking said second unit to said housing and releasing said second unit for movement relative to said housing, the disengaged position thereof.

2. An adaptor according to claim 1, wherein said locking means is constituted by latching means having snap-fitting interengagment which is effected automatically by engagement of said units.

3. An adaptor according to claim 1, wherein the second unit is constituted by a male insert and said housing is formed with an opening to receive and house said second unit.

4. An adaptor according to claim 1, wherein said housing and second unit are provided with co-operating guide means permitting interengagement and disengagement of said units by relative rectilinear movement in a direction corresponding with the longitudinal direction of the track conductors with which the adaptor co-operates in use.

5. An adaptor according to claim 4, wherein said co-operating guide means comprise longitudinal slots and co-operating ribs on said housing and second unit.

6. An adapter in accordance with claim 5 wherein said electrical appliance support means is supported on said second unit by means including a cable entry gland depending from and leading to the interior of said housing, said cable entry gland extending in a direction transverse to the direction of the longitudinal axis of said slots and ribs.

* * * * *